US005088216A

United States Patent [19]

Wasilko

[11] Patent Number: 5,088,216

[45] Date of Patent: Feb. 18, 1992

[54] DISPLAY HOLDER FOR CARDS, FLOWERS, AND THE LIKE

[76] Inventor: Carol Wasilko, 4728 Frederick Ave., Shady Side, Md. 20764

[21] Appl. No.: 666,078

[22] Filed: Mar. 7, 1991

[51] Int. Cl.[5] ..... G09F 1/10

[52] U.S. Cl. ..... 40/124.4; 47/41.13; 206/423

[58] Field of Search ..... 40/124, 124.4, 379, 40/401, 403; 211/60.1; 47/41.01, 41.13; 206/423; D6/556

[56] References Cited

U.S. PATENT DOCUMENTS

| | | | |
|---|---|---|---|
| 70,500 | 11/1867 | Averell . | |
| 1,465,636 | 8/1923 | Gmelin | 47/41.13 X |
| 1,740,118 | 12/1929 | Rand | 40/379 |
| 1,766,940 | 6/1930 | Powell | 40/379 |
| 2,220,189 | 11/1940 | Wolters | 40/379 |
| 2,916,843 | 12/1959 | Meyer . | |
| 3,144,941 | 8/1964 | Niino . | |
| 3,245,175 | 4/1966 | Klingberg | 47/41.13 |
| 3,263,355 | 8/1966 | March . | |
| 3,483,742 | 12/1969 | Murray . | |
| 3,524,274 | 8/1970 | Glassburn . | |
| 3,789,526 | 2/1974 | Lavinson | 40/124 |
| 3,987,566 | 10/1976 | March | 40/124.4 |
| 4,270,290 | 6/1981 | Eckert | 40/403 X |
| 4,432,161 | 2/1984 | de Bruin | 206/423 X |
| 4,852,280 | 8/1989 | Beattie . | |

*Primary Examiner*—Kenneth J. Dorner

*Assistant Examiner*—J. Bonifanti

*Attorney, Agent, or Firm*—Mason, Fenwick & Lawrence

[57] ABSTRACT

A display holder comprises a bottom portion for displaying cards and a top portion for holding flowers and the like. The bottom portion comprises a base, a solid cylindrical inner sleeve extending upwardly from the base, and a cylindrical outer sleeve concentric with the inner sleeve and extending upwardly from the base, all unitarily formed, preferably of a lightweight plastic. The cylindrical outer sleeve comprises a lower upstanding rim and retaining posts extending upwardly from the rim concentric with and outwardly of the inner sleeve. The free ends of the posts are retained by a rim with a downwardly depending lip formed at the upper end of the inner sleeve. The posts are flexible and resilient, so that they can be flexed for removal from underneath the rim on the inner sleeve, to permit insertion of a top of side-fold greeting card. The posts are provided with longitudinal slits, for receiving a postcard or other single sheet. The top portion comprises a circular bottom wall and a cylindrical side wall. The top portion has an outer diameter which permits it to be slidably inserted into the top of the inner sleeve. The top portion is prevented from falling into the inner sleeve by an inwardly-projecting shoulder formed in the inner surface of the inner sleeve, inset from the top. The bottom wall of the top portion is formed with apertures therethrough for receiving flower stems, balloon sticks, or the like.

20 Claims, 2 Drawing Sheets

FIG. 3
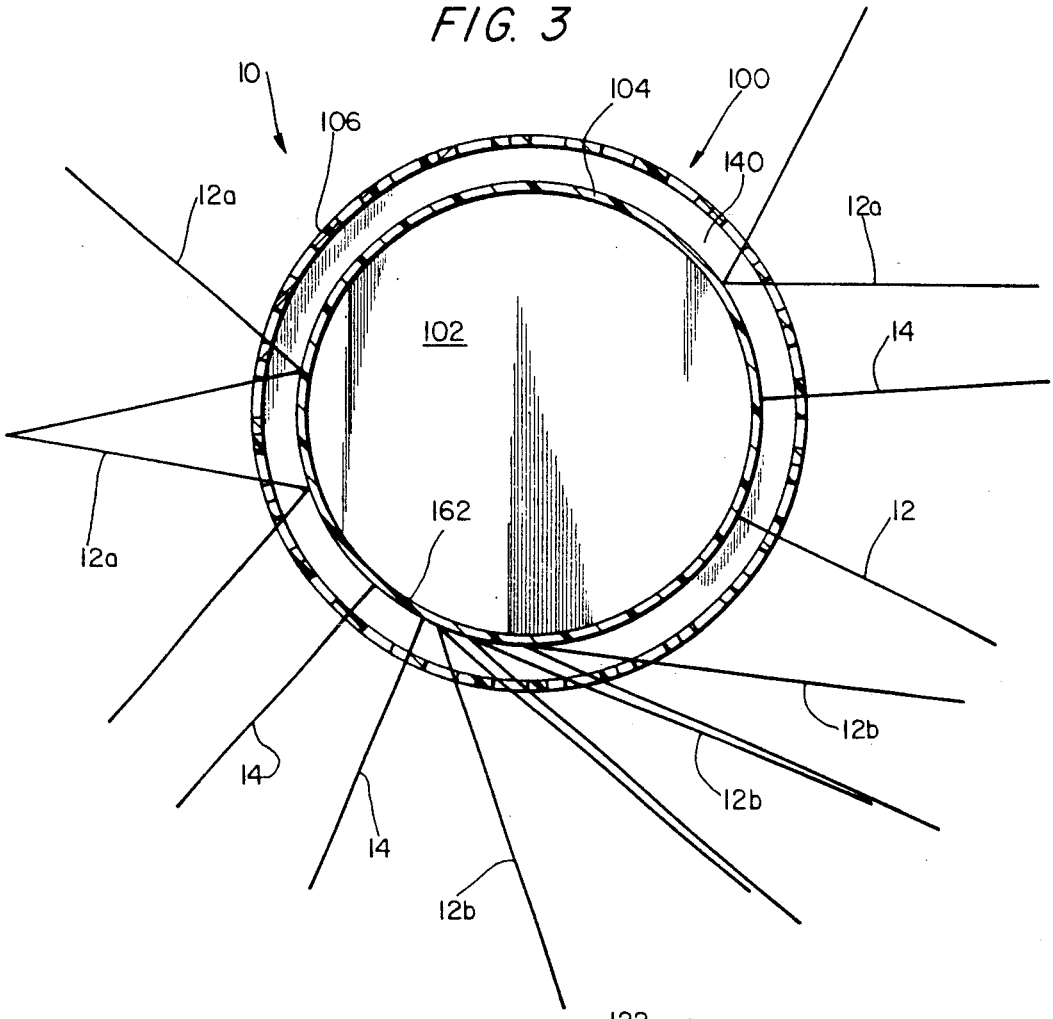
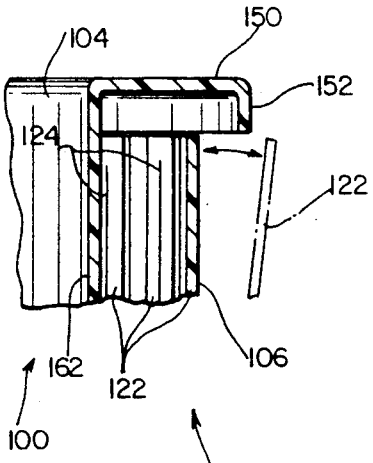
FIG. 4
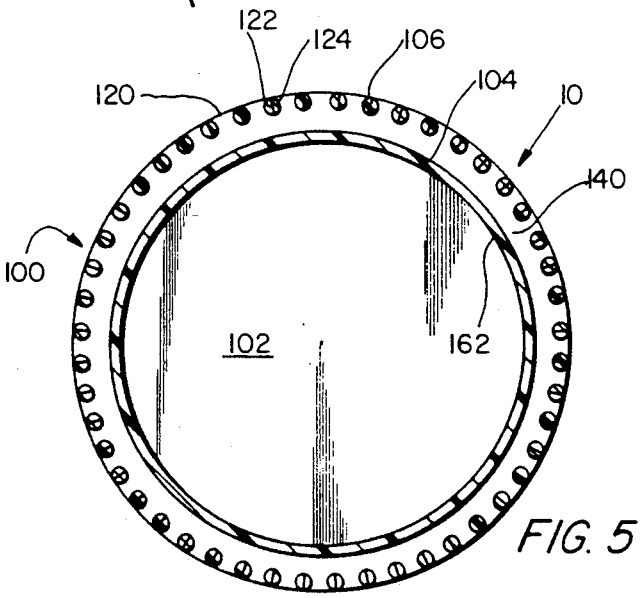
FIG. 5

DISPLAY HOLDER FOR CARDS, FLOWERS, AND THE LIKE

BACKGROUND OF THE INVENTION

1. Field of the Invention

The present invention generally relates to display holders, and more specifically, to a display holder for simultaneously displaying cards and flowers or other decorative objects having stems or sticks, or for simultaneously displaying cards and holding a bottle.

2. Related Art

Patients in hospitals frequently receive greeting cards, post cards, flowers, balloons on sticks, and the like, and new mothers may even receive a bottle of champagne or wine. However, storage and display space in hospital rooms, even in private and semi-private rooms, generally is limited to a small nightstand, and perhaps a window ledge. Moreover, hospitals rarely have vases o other containers in which to place flowers received by patients. Thus, due to lack of storage and display space, the hospital patient ma have to dispose of the cards and flowers which were sent to cheer him or her up.

A number of different devices have been proposed for holding cards. Examples of these are U.S. Pat. No. 70,500 to Averell; U.S. Pat. No. 2,916,843 to Meyer; U.S. Pat. No. 3,144,941 to Niino; U.S. Pat. No. 3,263,355 to March; U.S. Pat. No. 3,483,742 to Murray; U.S. Pat. No. 3,524,274 to Glassburn; U.S. Pat. No. 3,789,526 to Lavinson; U.S. Pat. No. 3,987,566 to March; and U.S. Pat. No. 4,852,280 to Beattie. Most of these, exemplified by the patents to March, Glassburn, Murray, Niino, Meyer, and Averel, are designed to hold and display only cards.

The holding and displaying apparatus disclosed by Beattie comprises a hollow cylindrical form open at both ends and having an elastic cord or the like wrapped around the cylindrical form in successive loops to receive side or top-fold greeting cards. Although the open top would permit insertion of other, extraneous objects, the open bottom limits its utility for storing anything other than greeting cards.

Lavinson discloses a card holder comprising a hollow cylindrical body portion having cleat-like elements extending therefrom around which a cord is wound to retain greeting cards or the like. A body portion is provided with a removable, decorative cover, and can be used to store candy, cookies, or even a plant.

The use of cord by both Lavinson and Beattie presents a significant disadvantage, in that if the two ends of the cord which are fastened together become separated, or if the cord breaks at any location, then the entire cord will detach from its supporting body and all of the displayed cards will fall off. It is the solution of this and other problems to which the present invention is directed.

SUMMARY OF THE INVENTION

Accordingly, it is a primary object of the present invention to provide a display holder for the simultaneous display of cards and flowers, balloons on sticks, and the like, or the simultaneous display of cards and storage of a bottle or the like.

It is another object of the invention to provide a display holder which ca hold and display top and side-fold greeting cards, as well as postcards or other articles comprising a single sheet of paper.

It is another object of the present invention to provide a display holder for cards, flowers, and the like which is easy and economical to fabricate.

These and other objects of the invention are achieved by a display holder comprising a bottom portion and a top portion, the top portion being removably receivable at the upper end of the bottom portion. The bottom portion comprises a base, a solid cylindrical inner sleeve extending upwardly from the base, and a cylindrical outer sleeve concentric with the inner sleeve and extending upwardly from the base. The cylindrical outer sleeve comprises a lower upstanding rim and retaining members extending upwardly from the rim concentric with and outwardly of the inner sleeve. The fold of top and side-fold greeting cards can be placed between the retaining members and the inner sleeve to display the cards.

The retaining members comprise spaced-apart, posts having longitudinal slits formed therethrough. The free ends of the posts are retained by a rim with a downwardly depending lip formed at the upper end of the inner sleeve.

Preferably, the base, inner sleeve, and outer sleeve are unitarily formed of a light-weight plastic, and the posts are resilient, so that they can be flexed for removal from underneath the rim on the inner sleeve, to permit insertion of a top or side-fold greeting card. Alternatively, a postcard or other single sheet can be inserted through the slits in the posts.

The top portion comprises a circular bottom wall and a cylindrical side wall. The top portion has a outer diameter which permits it to be slidably inserted into the top of the inner sleeve. The top portion is prevented from falling into the inner sleeve by an inwardly-projecting shoulder formed in the inner surface of the inner sleeve inset from the top.

The bottom wall of the top portion is formed with apertures therethrough for receiving flower stems, balloon sticks, or the like.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 3 is a cross-sectional view of the display holder of FIG. 2, taken along line 3—3 of FIG. 2.

FIG. 4 is an enlarged view of the area shown by the broken circle in FIG. 2.

FIG. 5 is a horizontal, cross-sectional view of an alternate embodiment of the invention.

DETAILED DESCRIPTION OF THE PREFERRED EMBODIMENTS

Figure 1:
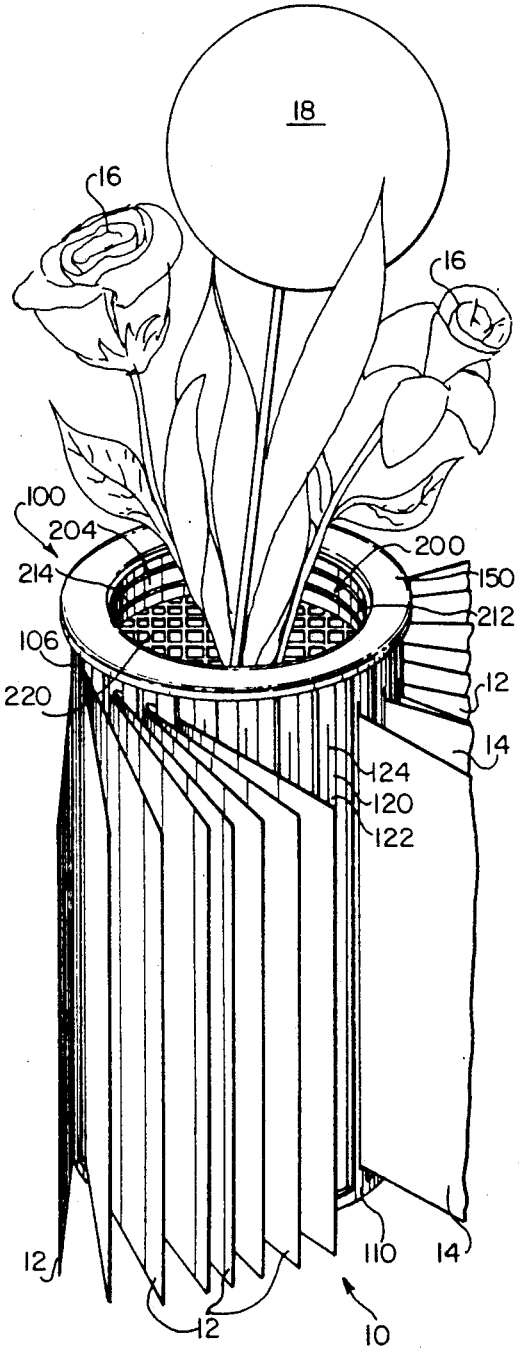
FIG. 1 is a perspective view of the display holder according to the present invention, in use holding flowers, a balloon on a stick, and greeting cards.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring to FIG. 1 through 4, there is shown a first embodiment of a display holder 10 for greeting cards 12, postcards 14, flowers 16, and balloons 18. Display holder 10 comprises a bottom portion 100 and a top portion 200.

Bottom portion 100 comprises a base 102, a solid cylindrical inner sleeve 104 extending unitarily upward from base 102, a cylindrical outer sleeve comprising a lower upstanding rim 110 extending upwardly unitarily from base 102, and retaining members 120 extending unitarily upwardly from rim 110 concentric with and outwardly of inner sleeve 104.

Retaining members 120 comprise spaced-apart, substantially planar posts !22 having longitudinal slits !22 formed therethrough. It should be understood that posts 122 are not truly planar, but in fact have a slight curve, inasmuch as each post 122 forms an arc of a cylinder. Alternatively, as shown in FIG. 5, posts 122 can be formed with a substantially circular cross-section and having longitudinal slits 124 formed therethrough. In either configuration, posts 122 are spaced apart from each other a sufficient distance to accommodate the sides of the cards between them.

Figure 2:
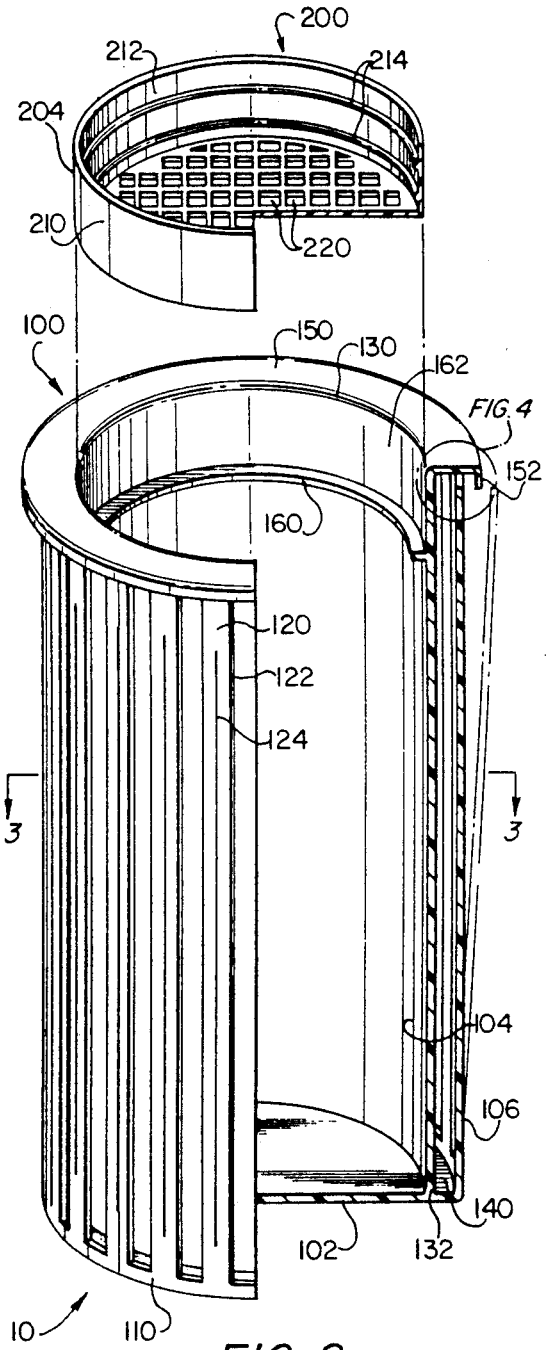
FIG. 2 is an exploded, perspective view of the display holder of FIG. 1, with parts cut away.

As can be seen most clearly from FIG. 2, longitudinal slits 124 preferably terminate short of the ends of posts 122, rather than extending the entire length of posts 122. In this way, posts 122 are stronger and less subject to splitting and breakage.

Inner sleeve 104 is open at its top 130 and closed at its bottom 132 by base 102. The outer diameter of inner sleeve 104 is smaller than the inner diameter of outer sleeve 106, so as to define an annular space 140 between inner and outer sleeves 104 and 106, for a purpose to be described hereinafter. Top 130 of inner sleeve 104 is formed with an outwardly extending annular rim 150 having a downwardly depending lip 152. Rim 150 extends outwardly of outer sleeve 106, so that posts 122 are held in position by lip 152.

Preferably, base 102, inner sleeve 104, and outer sleeve 106 are unitarily formed of a lightweight plastic such as polystyrene so that posts !22 can be flexed to remove them from or to replace them back under rim 150 and its depending lip 152, but are resilient so as to return to an upright position upon flexing.

An inwardly extending annular shoulder 160 is unitarily formed on the inner surface 162 of inner sleeve 104, for a purpose to be described hereinafter.

Top portion 200 comprises a circular bottom wall 202 and a cylindrical side wall 204 extending upwardly from bottom wall 202. Outer surface 210 of side wall 204 is smooth, and the outer diameter of side wall 204 is slightly smaller than the inner diameter of inner sleeve 104, but greater than the inner diameter of shoulder 160 of inner sleeve 104, so that top portion 200 can be slidably received in top 130 of inner sleeve 104 and rest on shoulder !60. The inner surface 212 of side wall 204 can be formed with unitary, inwardly extending ridges 214, so that top portion 200 can easily be grasped from inside to remove it from bottom portion 100.

Bottom wall 202 of top portion 200 is formed with a plurality of apertures 220 therethrough for receiving flower stems 16' and balloon sticks 18' or the like.

Preferably, as shown in 1, top portion 200 is totally recessed within inner sleeve 104, so as to be less visible. Thus, shoulder 160 preferably is inset from top 130 of inner sleeve 104 by a distance approximately equal to or slightly greater than the height of top portion 200.

Display holder 10 can be made from any suitable lightweight, easily moldable plastic. It can, for example, be made from the same plastic as the other articles provided to hospital patients, such as cups, water pitcher, and wash basin, and because it can be manufactured inexpensively, it can even be provided to hospital patients with these other articles. Display holder 10 can also be made of a somewhat heavier plastic, for example of the kind used by florists to hold floral arrangements, and can then be used by florists for floral arrangements being delivered to hospital patients.

In use, a side or top-fold greeting card is inserted into display holder 10 by flexing one of posts 122 to move it outwardly of lip 152. The fold of the card 12 is then placed behind post 122 into the annular space 140. The sides of the card can be oriented outwardly, as shown by card **12*a* in FIG. 3, or angled to one side, as shown by cards 12*b* in FIG. 3. Once the card 12 has been placed on its respective post 122, post 122 is flexed to replace it behind lip 152. As can be seen, lip 152 both provides additional rigidity for inner sleeve 104, as well as retaining posts 122 and preventing cards 12 from being accidently displaced. Postcards 14 or other single sheets of paper are simply inserted through slits 124 in posts 122, without the need for removing posts 122 from behind lip 152**.

In order to display flowers 16 or balloons 18, the stem 16' of each flower 16 or the stick 18' of the balloon 18 is inserted into one of apertures 220 in top portion 200. Apertures 220 permit flowers 16 and balloons 18 on sticks 18' to be oriented in a relatively upright position even if the stems 16' and sticks 18' are substantially taller than display holder 10, or when there are only a few flowers or balloons. The closed construction of inner sleeve 104 permits water to be placed therein for flowers 16.

To hold a bottle, for example a bottle of wine, top portion 200 is simply removed. The closed bottom of inner sleeve 104 permits ice to be placed on the bottom, so that the contents of the bottle can be chilled.

Modifications and variations of the above-described embodiments of the present invention are possible, as appreciated by those skilled in the art in light of the above teachings. For example, if a "designer" look is desired, base 102 and outer sleeve 106 could be formed unitarily of wood, while inner sleeve 104 is formed of glass and provided with a closed bottom. Also, the shape of bottom and top portions 100 and 200 can be varied. For example, they could be formed having a square, rectangular, triangular, or other non-circular horizontal cross-section. It is therefore to be understood that, within the scope of the appended claims and their equivalents, the invention may be practiced otherwise than as specifically described.

What is claimed is:

1. A display holder for cards, flowers, and stemmed objects, comprising:

a bottom portion having a solid base, an inner sleeve extending upwardly from said base, and an outer sleeve axially aligned with said inner sleeve and extending upwardly from said base, said outer sleeve comprising a plurality of elongated, spaced-apart upwardly-extending post means for holding cards, said post means being flexible and resilient and having upper free ends and being spaced apart from said inner sleeve, and said inner sleeve having an open upper end including retaining means for retaining said free ends of said post means; and a top portion slidably receivable in said upper end of said bottom portion, said top portion including holder means for holding flowers, balloons with stems, and stemmed objects in an upright position;

said bottom portion also having an inner surface having support means for supporting said top portion.

2. The display holder of claim 1, wherein said base and said inner and outer sleeves are formed unitarily.

3. The display holder of claim 1, wherein each of said post means has a longitudinal slit therethrough.

4. The display holder of claim 1, wherein said top portion further includes a side wall extending upwardly from said bottom wall, and said side wall has an inner surface having gripping means for gripping said inner surface for removing said top portion from said bottom portion.

5. The display holder of claim 1, wherein said base means and said top and bottom portions have circular, horizontal cross-sections, and said top portion has a circular, horizontal cross-section.

6. The display holder of claim 1, wherein said holder means includes a bottom wall having a plurality of apertures therethrough.

7. The display holder of claim 6, wherein said bottom wall is at least partially in the form of a grid.

8. The display holder of claim 1, wherein said retaining means comprises a rim extending outwardly from said upper end of said inner sleeve and a lip depending downwardly from said rim.

9. A display holder for cards, flowers, and stemmed objects, comprising:

a bottom portion having a solid base, an inner sleeve extending upwardly from said base, and an outer sleeve axially aligned with said inner sleeve and extending upwardly from said base, said outer sleeve comprising a lower, upstanding rim spaced apart from said inner sleeve and a plurality of elongated, spaced-apart post means extending upwardly from said rim for holding cards, said post means being flexible and resilient and having upper free ends and said outer sleeve having an open upper end including retaining means for retaining said free ends of said post means; and a top portion slidably receivable in said upper end of said bottom portion, said top portion including a bottom wall having holder means therein for holding flowers, balloons with stems, and stemmed objects in an upright position, and a side wall extending upwardly from said bottom wall, said side wall having an inner surface having gripping means for gripping said inner surface for removing said top portion from said bottom portion;

said bottom portion also having an inner surface having support means for supporting said top portion.

10. The display holder of claim 9, wherein said base and said inner and outer sleeves are formed unitarily.

11. The display holder of claim 9, wherein each of said post means has a longitudinal slit therethrough.

12. The display holder of claim 9, wherein said base means and said top and bottom portions have circular, horizontal cross-sections, and said top portion has a circular, horizontal cross-section.

13. The display holder of claim 9, wherein said bottom wall is at least partially in the form of a grid.

14. The display holder of claim 9, wherein said retaining means comprises a rim extending outwardly from said upper end of said inner sleeve and a lip depending downwardly from said rim.

15. A display holder for cards, flowers, and stemmed objects, comprising:

a solid base;

an outer sleeve extending upwardly from said base, said outer sleeve comprising a plurality of elongated, spaced-apart upwardly-extending posts, said posts being flexible and resilient and having upper free ends; and an inner sleeve extending upwardly from said base, said inner sleeve being axially aligned with and inset from said outer sleeve, and said inner sleeve having an open upper end including retaining means for retaining said free ends of said posts.

16. The display holder of claim 15, further comprising holder means slidably receivable in said.. inner sleeve, for holding flowers, balloons with stems, and stemmed objects in an upright position.

17. The display holder of claim 15, wherein said base and said inner and outer sleeves are formed unitarily.

18. The display holder of claim 15, wherein each of said posts has a longitudinal slit therethrough.

19. The display holder of claim 15, wherein said base means and said top and bottom portions have circular, horizontal cross-sections, and said top portion has a circular, horizontal cross-section.

20. The display holder of claim 15, wherein said retaining means comprises a rim extending outwardly from said upper end of said inner sleeve and a lip depending downwardly from said rim.

* * * * *